United States Patent [19]

Kida et al.

[11] Patent Number: 4,727,688

[45] Date of Patent: Mar. 1, 1988

[54] RETRACTABLE ROOF STRUCTURE

[75] Inventors: Yukio Kida; Toru Aoyagi, both of Tokyo, Japan

[73] Assignee: Ohbayashi-Gumi, Ltd., Osaka, Japan

[21] Appl. No.: 921,416

[22] Filed: Oct. 22, 1986

[30] Foreign Application Priority Data

Apr. 8, 1986 [JP] Japan ..... 61-79099
Aug. 7, 1986 [JP] Japan ..... 61-184313

[51] Int. Cl.[4] ..... E04H 3/10
[52] U.S. Cl. ..... 52/6; 52/66
[58] Field of Search ..... 52/6, 8, 66, 81

[56] References Cited

FOREIGN PATENT DOCUMENTS 772349 11/1967 Canada ..... 52/66
235066 6/1911 Fed. Rep. of Germany ..... 52/64
44-15346 7/1969 Japan .
44-15345 7/1969 Japan .
47-32620 8/1972 Japan .
60-85137 5/1985 Japan .
60-88744 5/1985 Japan .
613249 9/1979 Switzerland ..... 52/66

*Primary Examiner*—John E. Murtagh
*Attorney, Agent, or Firm*—Wenderoth, Lind & Ponack

[57] ABSTRACT

A retractable roof structure includes a stationary section having an opening in the central portion thereof and fixedly installed on a side wall constructed on the ground, and a retractable section for covering the opening. The retractable section includes a plurality of movable roof units which correspond to regions defined by dividing radially from a center portion of the opening each of not less than two concentric areas of the opening. The roof units in an inner area are retractable over the roof units in radially adjacent outer area, and the roof units in the outermost area are retractable with the roof units of the inner area retracted thereon over the stationary section.

5 Claims, 11 Drawing Figures

RETRACTABLE ROOF STRUCTURE

BACKGROUND OF THE INVENTION

1. Field of the Invention

The present invention relates to a roof structure and, more specifically, to a retractable roof structure capable of being partially opened.

2. Description of the Prior Art

As is generally known, the buildings of stadiums for baseball games and for athletic sports are not provided with any roof in order that sporting events, such as baseball games and athletic sports, can be performed in an environment resembling the natural environment as close as possible. However, in such a conventional stadium, the sporting event is obliged to be postponed when it rains on the prearranged day or the sporting event is obliged to be interrupted when it starts raining while the sporting event is being performed.

Recently, all-weather stadiums have been proposed in order to eliminate the foregoing disadvantages of the conventional stadium. The pneumatic film roof structure, for instance, is one notable roof structure for an all-weather stadium. However, the pneumatic film roof structure has the following problems.

The pneumatic film roof structure has a roofing made of a synthetic resin film or the like, and is incorporated into the building of a stadium. In such a stadium, pressurized air having a pressure slightly higher than the atmospheric pressure is supplied into the sealed building. Therefore, the doorways of the building need to be formed in a complicated construction to prevent the leakage of the internal air. Furthermore, the pneumatic film roof structure makes the internal lighting and ventilation of the building difficult and spoils the pleasure of performing or watching the sporting event in a natural environment.

A partially retractable roof structure has been proposed in a copending U.S. application Pat. No. 882,979, which has a roof section comprising movable roof units capable of being moved along guide members for covering and uncovering an opening formed in a stationary roof unit, and capable of being retracted into the stationary roof unit.

SUMMARY OF THE INVENTION

The present invention is intended to improve the retractable roof structure of the previous application as described above, and it is an object of the present invention to provide a retractable roof structure in which an opening ratio, namely, the ratio of the area of the opening to the overall area of the roof structure, may be increased and the weight of movable roof sections may be decreased to reduce the load on driving means such as motors, and which is capable of being moved rapidly for covering and uncovering the opening in a short time.

In order to achieve the above object, a retractable roof structure according to the present invention comprises a stationary section fixed to a side wall constructed on the ground and defining a central opening inside thereof, and a retractable section for opening and closing the central opening. The retractable section comprises a plurality of movable roof units corresponding to regions defined by dividing radially from a center portion of the opening each of not less than two concentric areas of the opening. The roof units in the inner area are retractable over the roof units in the radially adjacent outer area, and the roof units in the outermost area are retractable with the roof units of the inner area retracted thereon over the stationary section.

The present invention is applicable to roof structures of any optional shape, such as of a rectangular shape, as well as to circular roof structures. When the present invention is applied to a circular roof structure having a central opening of circular shape, the term "center portion" from which the opening is radially divided shall mean a center of the circular opening. On the other hand, when the invention is applied to a rectangular roof structure having a rectangular opening, the "center portion" is a fraction of the center line of such opening, and the concentric areas are divided along lines extending from each end of the fraction to the opposite corners adjacent to that end.

Since each movable roof unit for covering each region of the opening may have a small width (radial length), the stationary section which accommodates all the roof units thereon when the opening is fully opened may be formed of a small width. Therefore, the retractable roof structure according to the present invention may have a large opening ratio, which creates an environment more like the natural environment as compared with the conventional roof structure, when the opening is fully opened. Furthermore, since each roof unit is small and lightweight, the retractable section can smoothly and speedily be moved by a small driving force to cover or uncover the opening.

In a preferred embodiment of the present invention, each movable roof unit is moved along a guide beam extending between the inner circumference of the stationary section and the center portion of the opening. A guide rail is provided on the upper surface of the guide beam, and the roof unit may be provided practically in the middle portion thereof with respect to the circumferential direction with running means which travels along the guide rail.

According to one embodiment of the present invention, the running means comprises a carrier roller attached to the lower surface of the roof unit, and a pair of retaining rollers disposed at the opposite sides of the carrier roller so as to roll along the backside of the guide rail. In another and more preferable embodiment of the invention, the running means is a carriage which is drawn by a cable member provided for each roof unit. Each cable member is extended around each of pulleys attached to the extremity of the guide beam and around each of driving wheels attached to the base end of a main guide rail on the stationary section, and the cable member has opposite ends fixed to the carriage. Thus, movable roof units can individually be moved.

The above and other objects, features and advantages of the present invention will become more apparent from the following detailed description of the invention taken in conjunction with the accompanying drawings, in which:

DETAILED DESCRIPTION OF THE INVENTION

Figure 1:
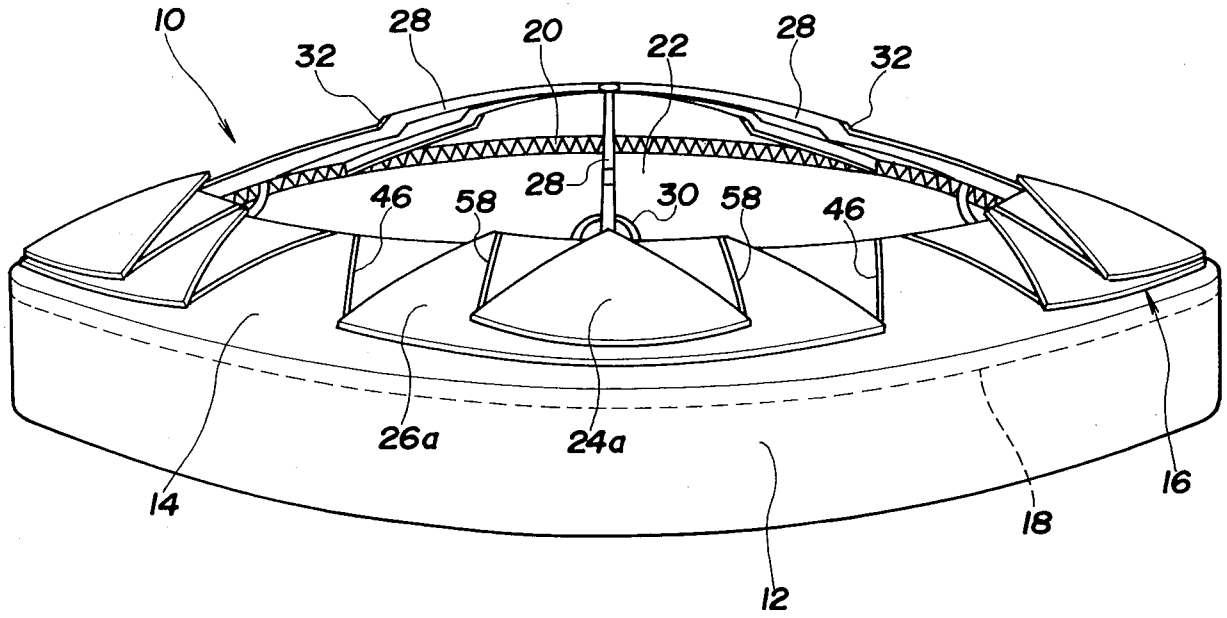
FIG. 1 is a schematic perspective view illustrating a retractable roof structure according to a first embodiment of the present invention.
Figure 2:
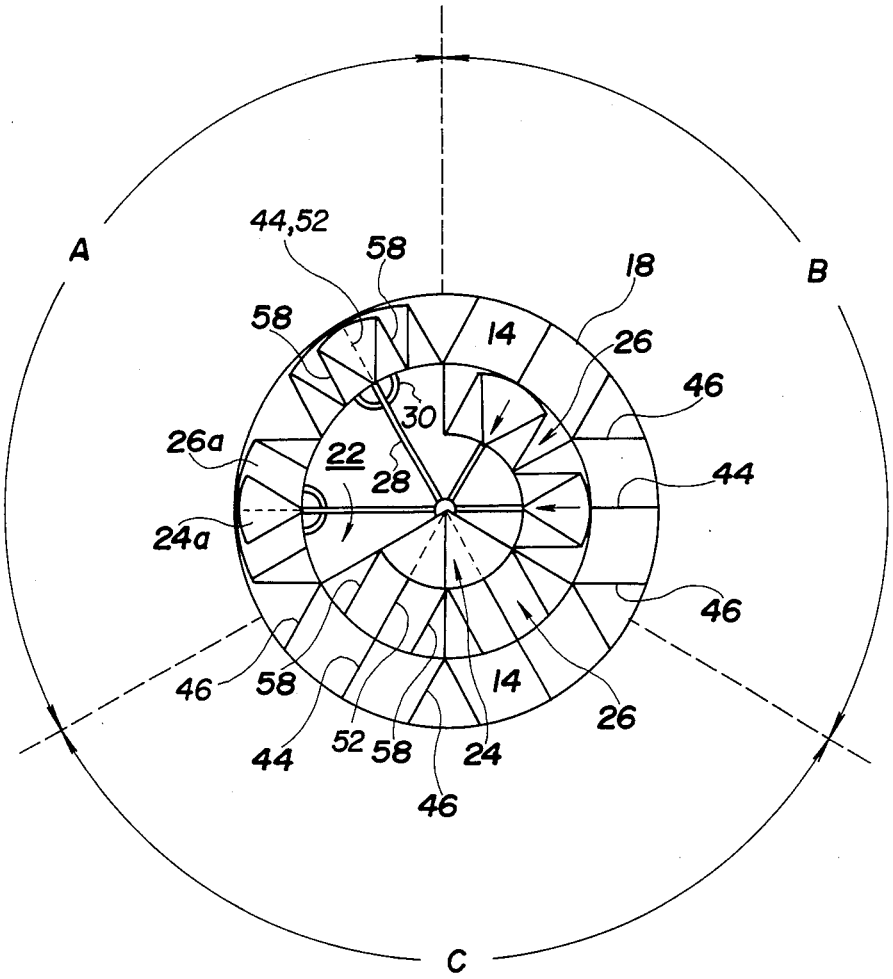
FIG. 2 is a plan view of the retractable roof structure of FIG. 1, of assistance in explaining the manner of dividing a central opening into regions and the mode of movement of roof units.
Figure 3:
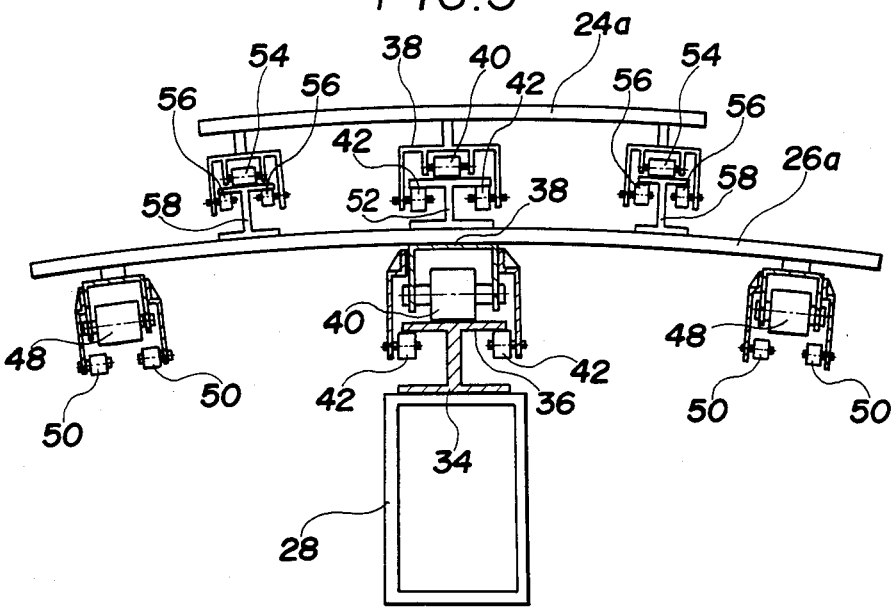
FIG. 3 is a sectional view of a roller mechanism for moving the roof units.

FIGS. 1 to 3 illustrate a dome-shaped partially retractable roof structure, in a first embodiment, according to the present invention. The dome-shaped roof structure 10 is constructed on a cylindrical side wall 12 built on the ground, and comprises a stationary section 14 and a retractable section 16. The stationary section 14 is an annular structure having an outer circumference fixedly secured to an outer beam 18 provided on top of the side wall 12, and an inner circumference to which an annular beam 20 is secured. As best shown in FIG. 2, the width (radial length) of the stationary section 14 is determined so that it covers an outermost area among three annular areas defined by concentrically dividing a plane surrounded by the side wall 12. Accordingly, an opening 22 corresponding to the other two concentric annular areas is defined within the inner circumference of the stationary section 14.

The retractable section 16 is intended to open and close the central opening 22, and comprises an inner portion 24 and an outer portion 26 for covering the inner area and the outer area of the opening 22, respectively. The inner portion 24 and the outer portion 26 are further divided, along radial lines extending radially from the center of the opening 22 at regular angular intervals, into six inner movable roof units 24*a* and into six outer movable roof units 26*a*, respectively. Thus, in this embodiment, the retractable section 16 comprises twelve roof units. The inner movable roof units 24*a* are sectorial, while the outer movable roof units 26*a* are substantially trapezoidal. The width (radial length) of the inner movable roof sections 24*a* is approximately the same as or slightly smaller than that of the outer movable roof sections 26*a*, while the width of the outer movable roof sections 26*a* is approximately the same as or slightly smaller than that of the stationary section 14.

Six guide beams 28 are extended from the annular beam 20 of the stationary section 14 to the center of the opening 22 at regular angular intervals so as to extend along respective middle portions, with respect to the circumferential direction, of the roof units 24*a* and 26*a*. In this embodiment, each guide beam 28 is joined pivotally at the base end thereof to the annular beam 20, and is supported for swinging motion on a semicircular supporting member 30 projecting from the annular beam 20 into the opening 22. The guide beam 28 is offset to form a shoulder 32 at a position corresponding to the boundary of the inner portion 24 and the outer portion 26, so that the part thereof extending inward from the shoulder 32 is raised relative to the outer part thereof. As illustrated in FIG. 3, a guide rail 34 having an H-shaped cross section is attached to the upper surface of each guide beam 28. A roller 40 rotatably held on a holding member 38 attached to the lower surfaces of each of the roof units 24*a* and 26*a*, respectively, rolls along the upper surface of the flange 36 of the guide rail 34. A pair of retaining rollers 42 are held rotatably on the holding member 38 so as to roll along the lower surfaces of the flange 36 to restrain the corresponding roof unit from lifting from the guide rail 34 and to enable the roof unit to move smoothly.

Main guide rails 44 similar to the guide rails 34 are provided on the upper surface of the stationary section 14 in alignment with the guide beams 28, respectively. A pair of auxiliary guide rails 46 are also provided in parallel to and each on the opposite side of each main guide rail 44 so as to guide rollers 48 and retaining rollers 50 provided on the lower surface of the opposite circumferential edges of the outer roof unit 26*a*. Attached to the upper surface of the outer roof unit 26*a* are a guide rail 52 for guiding the rollers 40 and the retaining rollers 42 of the inner roof unit 24*a*, and a pair of auxiliary guide rails 58 for guiding rollers 54 and a pair of retaining rollers 56 provided on the lower surface of the opposite circumferential edges of the inner roof unit 24*a*. Each of the roof units 24*a* and 26*a* has a plurality of sets of the rollers 40 and 42 distributed radially along the circumferentially central portions of the units, while one set of the rollers engaging a respective auxiliary guide rail is provided near each corner of the outer end of each unit.

The roof unit thus constituted is connected by a wire or a chain to an actuator, not shown, such as a motor, and is driven for movement by the actuator. The retractable section 16 is illustrated as fully retracted or opened in a zone "A" in FIG. 2 where the outer roof units 26*a* are seated over the stationary section 14 while the inner roof units 24*a* are seated on the corresponding outer units 26*a*, respectively. That is, the roof units 24*a* and 26*a* are seated in layers over the stationary section 14. Although the guide beams 28 are illustrated as extending toward the center of the opening 22 in the figure, actually, the guide beams 28 are turned on their pivots so that the respective extremities of the guide beams 28 are placed near the annular beam 20, when the opening 22 is fully opened. In closing the opening 22, first the guide beams 28 are turned to a position illustrated in FIG. 2 to form a frame, and then the outer roof units 26*a*, with the corresponding inner units 24*a* mounted thereon, are moved in a direction toward the center of the opening 22 along the guide rails 44 and 46 on the stationary section 14 and along the guide rails 34 provided on the guide beams 28. During this movement, it is preferable to apply a tension force through wires or the like to the inner units 24*a* so that an excessive load will not work on the outer units 26*a*.

After the outer units 26*a* have arrived at positions where the inner ends thereof are in abutment with the shoulders 32, respectively, as illustrated in a zone "B" in FIG. 2, the inner units 24*a* are moved toward the center of the opening 22 along the guide rails 52 and 58 on the outer units 26*a* and along the guide rails 34 on the guide beams 28 to close the opening 22 completely, as illustrated in a zone "C" in FIG. 2. Thus, the roof closing operation is completed.

In uncovering the opening 22, the steps of the roof closing operation are executed in the reverse order. That is, first the inner units 24a are moved radially outward until they are seated on the corresponding outer units 26a, and then the outer units 26a with the inner units 24a thereon are moved onto the stationary section 14. Both in opening and closing the retractable roof structure 10, the six of inner units 24a and the six outer units 26a are respectively moved simultaneously.

Although the opening 22 is divided into two concentric annular areas in this embodiment, naturally the number of areas is not limited thereto, but the opening 22 may be divided into an optional number of concentric annular areas.

Figure 4:
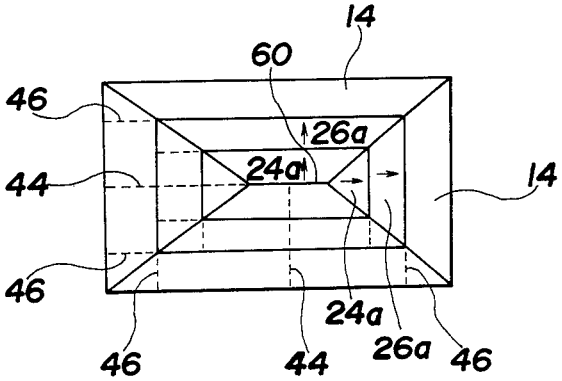
FIG. 4 is a view showing schematically a rectangular roof structure according to a second embodiment of the present invention.

FIG. 4 illustrates a retractable roof structure having a rectangular shape in a plan view, in a second embodiment according to the present invention. The second embodiment is designed to cover a rectangular plane. The rectangular plane is divided into three concentric rectangular areas, more precisely, into one rectangular area, and two hollow rectangular areas. A stationary section 14 is formed so as to cover the outermost rectangular area. The middle and inner rectangular areas are further divided along lines extending between one end of a central fraction 60 of the center line of the rectangular plane and the opposite corners of one side of the rectangular plane adjacent to the one end, and lines connecting the other end of the fraction 60 and the opposite corners of the other side adjacent to the other end. The four regions of the middle rectangular area are closed by four outer roof units 26a, while the four regions of the inner rectangular area are covered with four inner roof units 24a, respectively. Other structures of this embodiment are substantially the same as those of the first embodiment, and each roof unit moves along the guide rails indicated by dotted lines to close and to open a rectangular central opening defined by the inner circumference of the stationary section 14.

One of advantages achieved by dividing the retractable section 16 concentrically and radially into plural units is that the width of each unit is reduced, resulting in a decrease of the width of the stationary section on which all of the roof units are received when the central opening is fully opened. Consequently, the opening ratio of the retractable roof structure is increased, and the wide opening enhances the degree of open-air feeling. Furthermore, since the individual roof units are small and therefore lightweight, the load on the movable roof section driving means is reduced, and thereby the roof opening and closing operation can be carried out smoothly and speedily.

Figure 5:
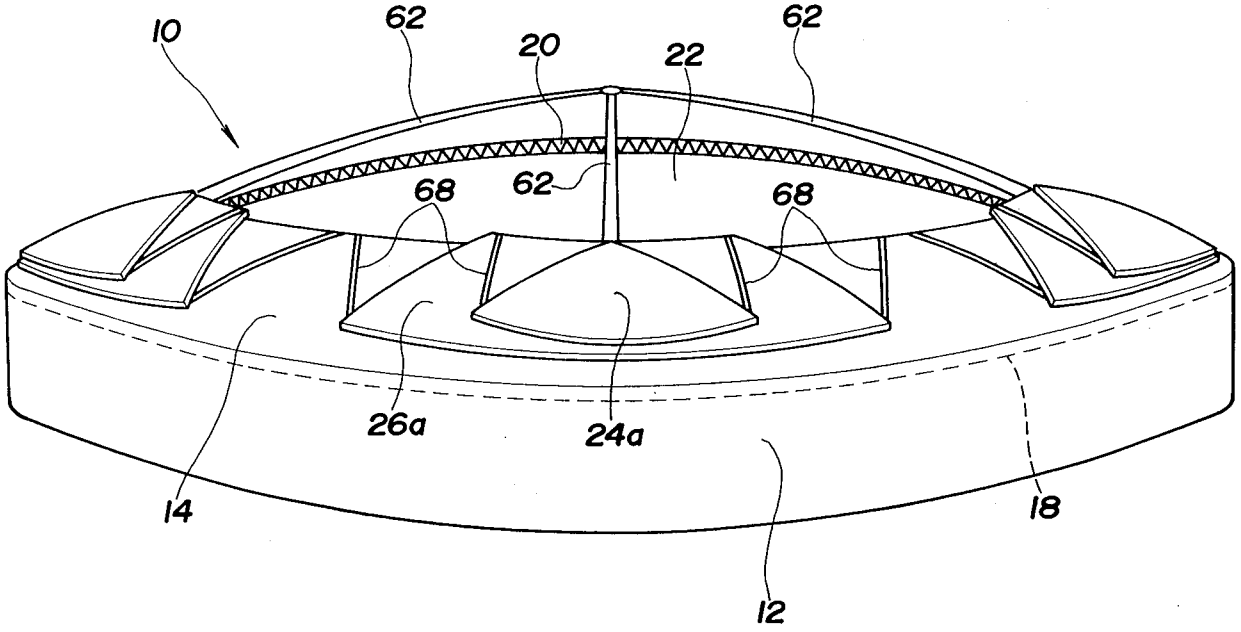
FIG. 5 is a schematic perspective view illustrating a retractable roof structure according to a third embodiment of the present invention.

FIGS. 5 to 9 illustrate a retractable roof structure in a third embodiment of the present invention. The third embodiment is different from the foregoing embodiments principally in the mechanism for moving the roof units 24a and 26a. The third embodiment has smooth curvilinear guide beams 62 without any offset portion. The respective base ends of the guide beams 62 are fixed to the annular beam 20, while the respective extremities thereof are joined together at the center of an opening 22. As illustrated in FIGS. 6A and 6B, free carriages 64 and 66 are attached to the lower surface of the inner roof unit 24a at the opposite edges of the outer end thereof, and to the lower surface of the outer roof unit 26a at the opposite edges of the rear end thereof, respectively. The carriages 64 and 66 travel along guide rails 68 extending on the upper surfaces of the outer roof unit 26a and the stationary section 14 as shown in FIG. 5. A driven carriage 70 is attached to the lower surface of the inner roof unit 24a at the center of the front end, and similarly a driven carriage 72 is attached to the outer roof unit 26a. The driven carriages 70 and 72 travel along guide rails 76 provided on a support 74 which extends on the guide beam 62 and the stationary section 14.

Figure 6A:
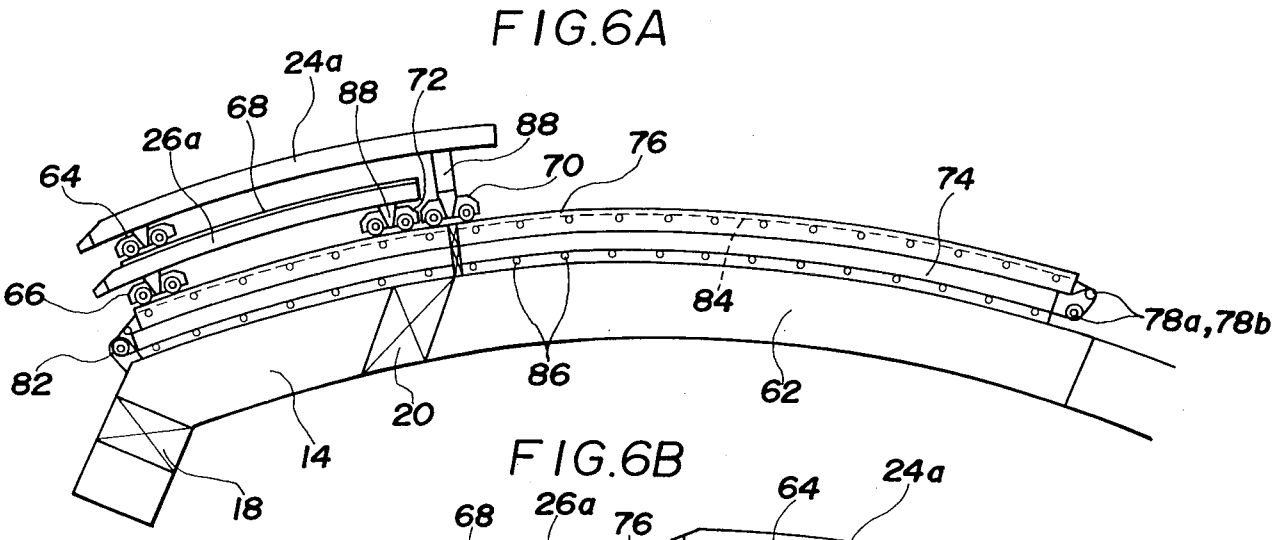
FIGS. 6A and 6B are side elevations showing a roller mechanism employed in the third embodiment, at a position where the opening is opened, and at a position where the opening is closed, respectively.
Figure 6B:
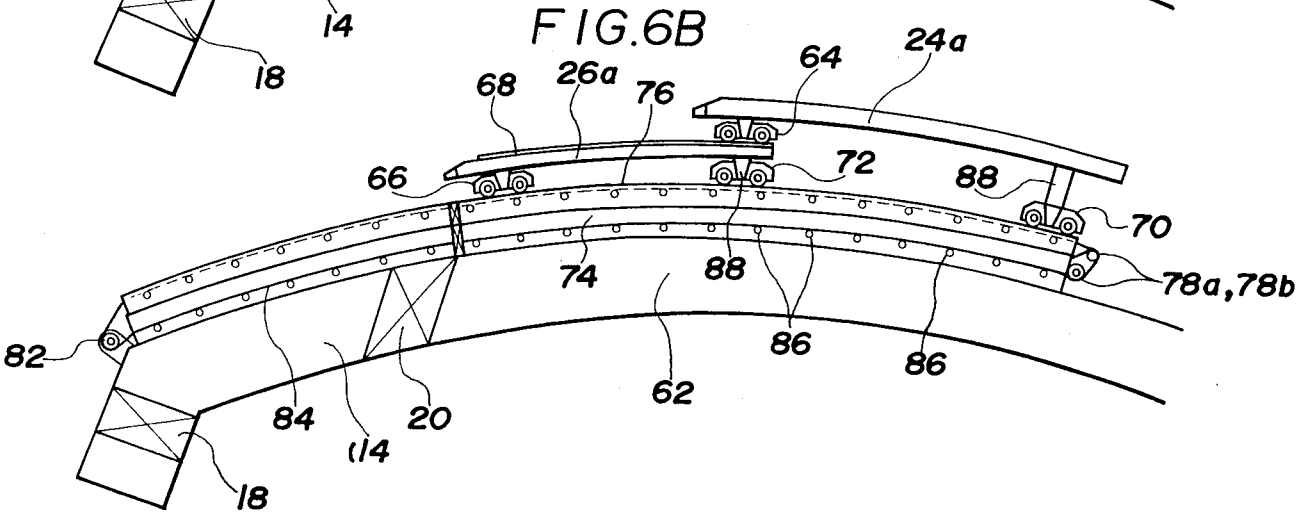
Figure 7:
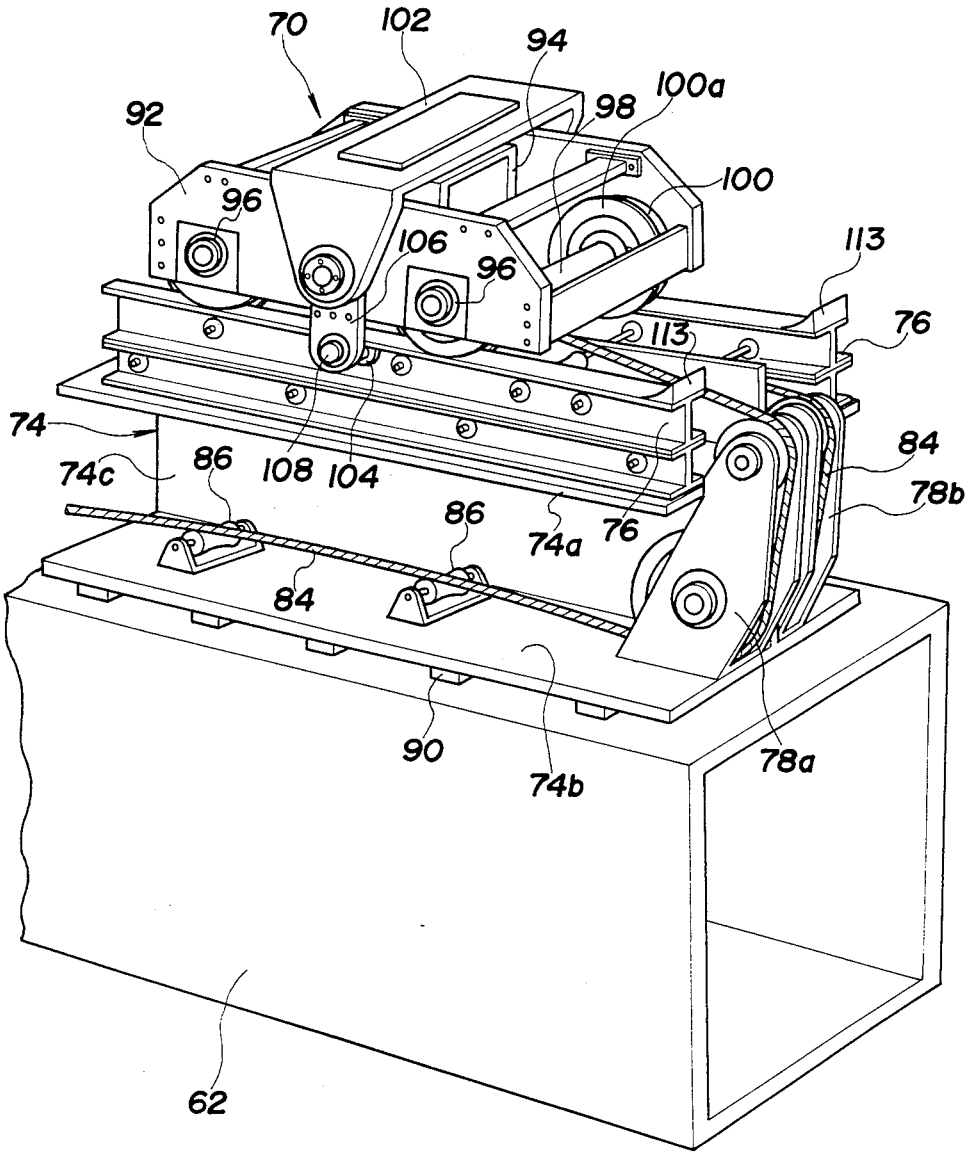
FIG. 7 is a perspective view showing a part of the mechanism shown in FIGS. 6A and 6B.

Each support 74 is extended substantially up to the extremity of the corresponding guide beam 62. As illustrated in FIG. 7, a pulley 78a for the inner roof unit 24a, and a pulley 78b for the outer roof unit 26a, each having two sheaves disposed one over the other, are disposed side by side at the extremity of the support 74. On the other hand, two drum-shaped driving wheels 82 (only one of them is shown in FIGS. 6A and 6B) are attached side by side to the stationary section 14 near the rear end of the support 74, each driving wheel 82 being interlocked with an output shaft of a motor (not shown). A wire 84 forming a cable member extends between each of the pulleys 78a and 78b and respective of the driving wheels 82. Both ends of the wire 84 extended around the pulley 78a are connected to the driven carriage 70, while both ends of the other wire 84 extended around the pulley 78b are connected to the driven carriage 72. A plurality of guide rollers 86 are provided on the support 74 and the guide rail 76 to guide the wires 84 properly so that the carriages 70 and 72 are driven smoothly. Preferably, the wires 84 are wound around the driving wheels 82 several times to prevent slippage of the wires relative thereto. Chains or belts may be used instead of the wires.

The carriages 64, 66, 70 and 72 are attached to the roof units by means of legs. As best shown in FIGS. 6A and 6B, the inner roof unit 24a is positioned above the outer roof unit 26a, and the length of the legs 88 for the driven carriages 70 and 72 are adjustable.

Figure 8:
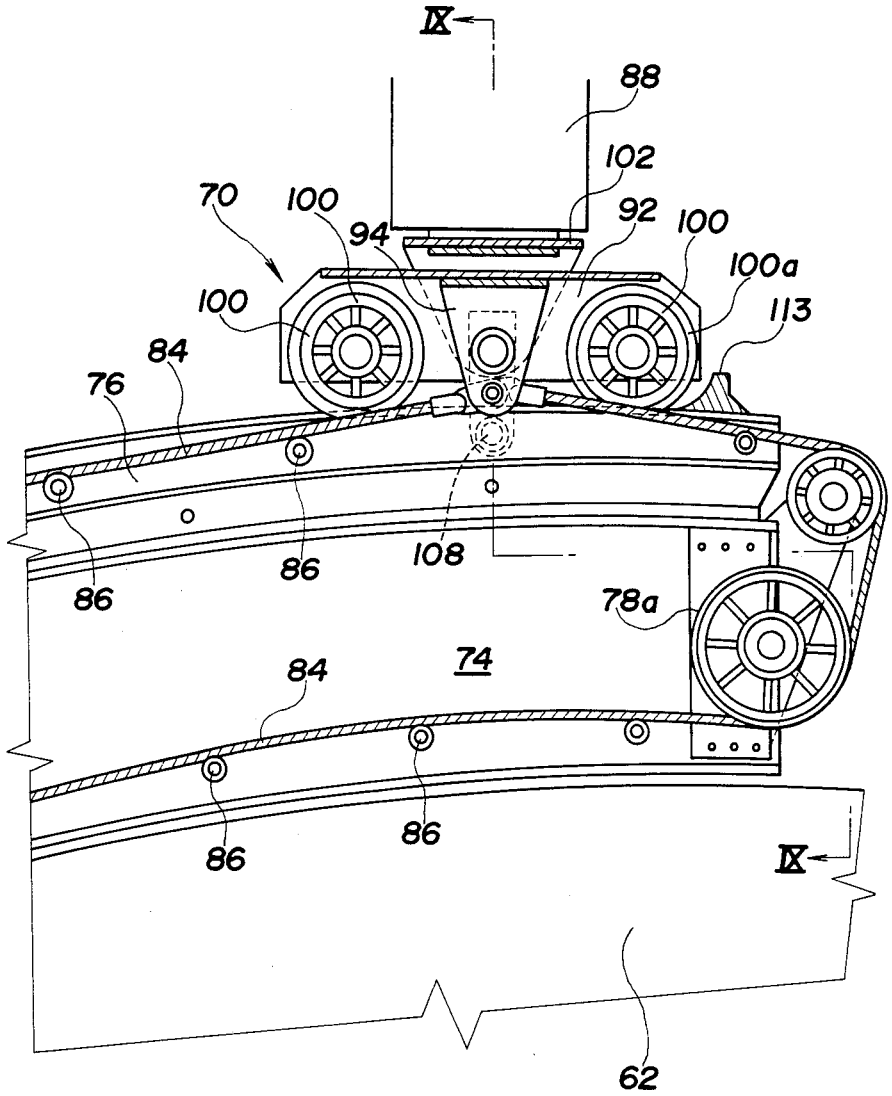
FIG. 8 is an enlarged side elevation thereof.
Figure 9:
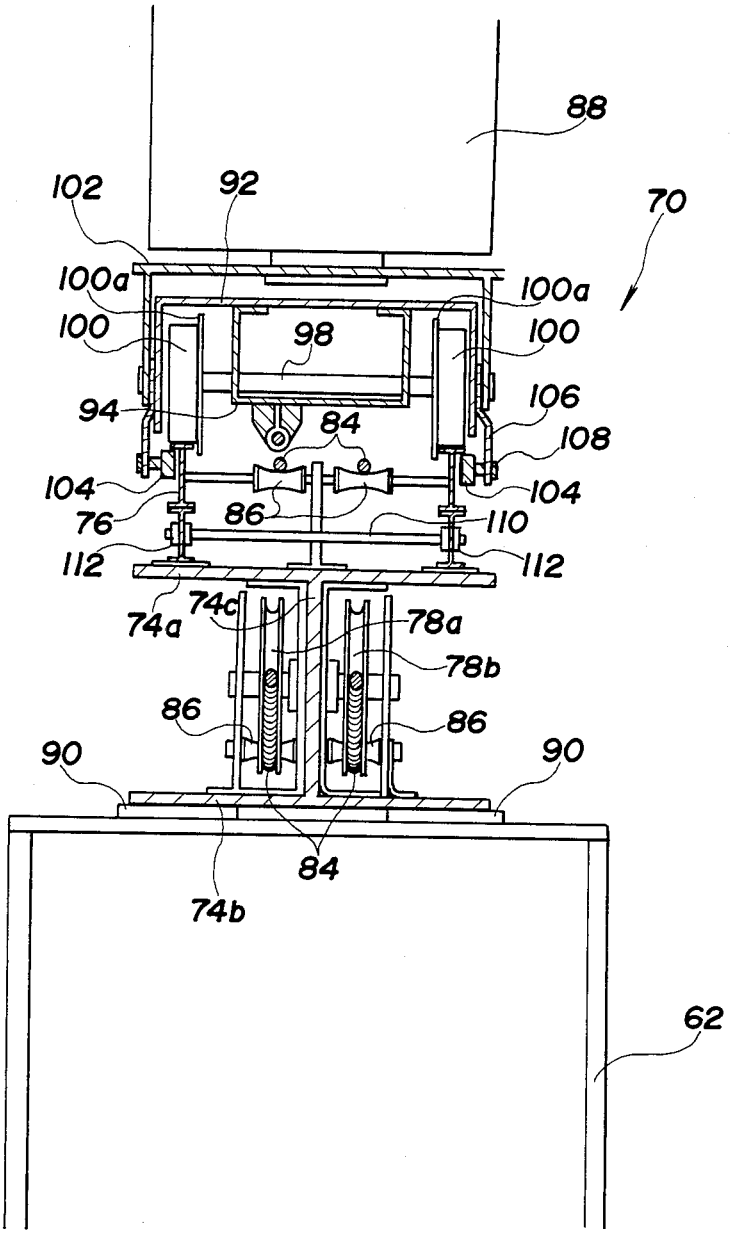
FIG. 9 is a sectional view taken on line IX—IX in FIG. 8.

FIGS. 7 to 9 illustrate the constitution of the driven carriage 70 in detail. As the constitution of the driven carriage 72 is entirely the same as that of the driven carriage 70, explanation thereof will be omitted. The H-shaped support 74 is secured on the guide beam 62 with vibration-proof members 90 therebetween. Extending upwardly from an upper flange 74a of the support 74 are a pair of guide rails 76 on which the driven carriage 70 is placed. As illustrated in FIG. 9, the guide rollers 86 are arranged along the longitudinal direction of the support 74 at the opposite sides of the web 74c thereof and between the guide rails 76. The driven carriage 70 has a frame 92 and a wire connector 94 fixed to the frame 92 with bolts, both ends of the wire 84 being connected to the wire connector 94. In assembling the retractable roof structure, after one end of the wire 84 is secured to the wire connector 94, the wire 84 is extended via the guide rollers 86 around the pulley 78a and the driving wheel 82, and then the other end of the wire 84 is secured to the wire connector 94. Accordingly, the driven carriage 70 is moved toward the extremity of the guide beam 62 or toward the stationary section 14 by drawing the wire 84 with the driving wheel 82. Both ends of the other wire 84 are connected similarly to the driven carriage 72.

A pair of axles 98 are supported rotatably in bearings 96 on the frame 92 of the driven carriage 70, and a pair of wheels 100 each having a flange 100a engaging the edge of a respective guide rail 76 are supported on each axle 98 for rolling movement along the guide rails 76. A saddle 102 for carrying the leg 88 thereon is mounted over the frame 92 and is pivotally supported at the respective centers of the opposite sides thereof on the opposite side walls of the frame 92 at the respective longitudinal centers, so that the saddle 102 serves as an equalizer for equally distributing the weight of the roof unit 24a to the front and rear wheels 100. Retaining rollers 104 are attached rotatably by pins 108 to the respective lower ends of holding plates 106 which are in turn fixedly joined at the upper ends thereof to the opposite side walls of the frame 92, respectively. The retaining rollers 104 rotate along the respective lower surfaces of the upper flanges of guide rails 76 to restrain the driven carriage 70 from being lifted from the guide rails 76 by wind or vibrations.

Tie bars 110 are provided between the guide rails 76 to hold the guide rails 76 to gauge. Each tie bar 110 has opposite ends fastened to the guide rails 76 by nuts 112, respectively. In FIG. 7, indicated at 113 are stoppers fixed to the extremities of the guide rails 76.

Figure 10:
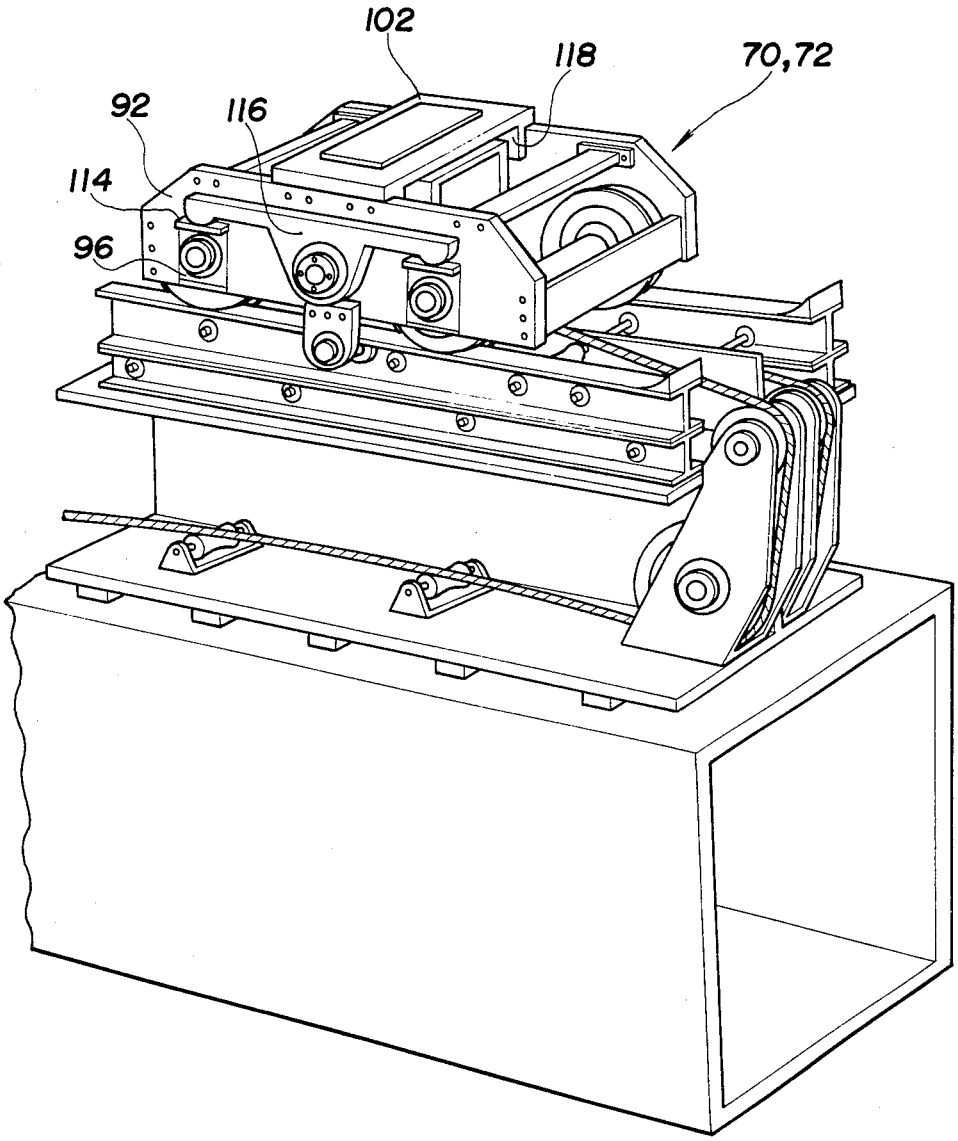
FIG. 10 is a perspective view illustrating another carriage.

FIG. 10 illustrates another driven carriage according to the present invention. The constitution of this driven carriage is different from that of the driven carriage of FIGS. 7 to 9 only in the following respects.

This driven carriage has separate equalizing levers 116 provided on the opposite side walls of the frame 92; lugs 114 are projected horizontally outward from the upper edges of bearings 96; each equalizing lever 116 is joined pivotally at the middle thereof to a respective side wall of the frame 92 such that the opposite ends of the lever are placed on the lugs 114; and the saddle 102 is bolted to the frame 92 with a pair of vertical projections 118 projecting from the lower surface of the saddle being in contact with the respective inner surfaces of the side walls of the frame 92.

The manner of operation of the third embodiment will be described. In FIG. 6A, the inner roof units 24a and the outer roof units 26a are fully retracted, that is, the opening 22 is opened. In closing the opening, the two driving wheels 82 are rotated practically at the same speed to move the driven carriages 70 and 72 simultaneously through the wires 84 in a direction toward the extremity of the guide beam 62; consequently, the inner roof units 24a and the outer roof units 26a are moved simultaneously toward the center of the opening 22. This means that the inner unit 24a remains stationary relative to the outer unit 26a, and hence the free carriages 64 of the inner unit 24a remain stationary on the guide rails 68 extending on the outer unit 26a while the free carriages 66 of the outer unit 26a move along the guide rails 68 on the stationary section 14. Upon the arrival of the outer roof unit 26a at a predetermined position, namely, at such a position as shown in the zone "B" in FIG. 2, the driving wheels 82 are stopped and the outer roof unit 26a is locked in place with suitable locking means. Then, the driving wheel 82 for driving the inner roof unit 24a is rotated to drive only the driven carriage 70. Thus, the inner unit 24a is moved again toward the center of the opening 22. Upon the arrival of the driven carriage 70 to the stoppers 113 provided at the extremiters of the guide rails 76, the driving wheel 82 is stopped and the inner unit 24a is locked at the position to complete the closing operation. In uncovering the opening 22, the same steps are carried out in the reverse order. That is, first the inner unit 24a is unlocked, and the driving wheel 82 therefor is rotated in the reverse direction to retract the inner unit 24a onto the outer unit 26a. When the free carriages 64 reach to the rear ends of the guide rails 68 of the outer unit 26a, the driving wheel 82 is stopped until the outer unit 26a is unlocked, and then both driving wheels 82 are rotated simultaneously. After both of the inner unit 24a and the outer unit 26a are retracted onto the stationary section 14, these units are locked to complete the uncovering operation. The six inner units 24a and the six outer units 26a are respectively operated simultaneously.

The degree of uncovering of the opening 22 is easily adjusted by separately driving the inner units 24a and the outer units 26a through the driven carriages 70 and 72, respectively. As is evident from the foregoing description, the inner unit 24a and the outer unit 26a are different from each other in weight, and hence the power required for driving the inner unit 24a is different from that for driving the outer unit 26a. According to the above embodiment, since the inner and outer units are driven by the two individual driving wheels 82 through the two separate wires 84, power of different magnitudes can be transmitted to the inner unit 24a and to the outer unit 26a, respectively, which enables reasonable control of the movable units.

Although the present invention has been described in its preferred embodiments with a certain degree of particularity, it is to be understood that many variations and changes may be made without departing from the scope and spirit of the invention.

What is claimed is:

1. A retractable roof structure comprising:

a stationary roof section fixed to a side wall constructed on the ground and defining a central opening inside said stationary roof section;

a plurality of guide beams extending between the inner circumference of said stationary section and the center of said central opening;

a plurality of guide rails, each said guide rail extending along a respective said guide beam and on said stationary roof section;

a retractable roof section for opening and closing said central opening and comprising a plurality of movable roof units corresponding to regions defined by dividing radially from a center portion of said central opening each of not less than two concentric areas of said central opening, said roof units in the inner said area being retractable over respective said roof units in the radially adjacent outer said area, and said roof units in the outermost said area being retractable with respective said roof units of the radially adjacent inner said area retracted thereon over said stationary section;

a carriage mounted on each said movable roof unit substantially at the circumferentially middle portion thereof, said carriages traveling along respective said guide rails;

a plurality of cable members, each said cable member being connected to a respective said carriage; and separate drive means, operatively connected to respectively said cable members, for each of said roof units for permitting individual movement of each said roof unit such that, when closing said central opening, respective said roof units in the inner and outer areas are moved together at substantially the same speed to a position where each said roof unit in the outer area is fully extended from said stationary roof section, and then only said roof units in said inner area is further moved to extend from said roof units in said outer area.

2. A retractable roof structure as claimed in claim 1, wherein said drive means includes drive wheels attached to the outer base end of each said guide rail, and further comprising pulleys attached to the inner extremity of each said guide beam.

3. A retractable roof structure as claimed in claim 2, wherein each said cable member is extended around a respective said pulley and around a respective said driving wheel, and both ends of said cable member are fixedly connected to the respective said carriage.

4. A retractable roof structure as claimed in claim 3, wherein each said guide rail comprises a pair of rails, and each said carriage includes a frame and a pair of front wheels and a pair of rear wheels supported rotatably on said frame.

5. A retractable roof structure as claimed in claim 4, wherein each said carriage further includes a pair of retaining rollers which roll along the lower surfaces of respective said rails.

* * * * *